United States Patent [19]

Othmer

[11] 3,974,398

[45] Aug. 10, 1976

[54] WIRE AND STEEL TUBE AS AC CABLE

[76] Inventor: Donald F. Othmer, 333 Jay St., Brooklyn, N.Y. 11201

[22] Filed: Oct. 11, 1973

[21] Appl. No.: 405,705

Related U.S. Application Data

[63] Continuation-in-part of Ser. No. 107,351, Jan. 18, 1971, Pat. No. 3,777,117, which is a continuation of Ser. No. 805,718, March 10, 1969, Pat. No. 3,617,699.

[52] U.S. Cl. ..... 307/147

[51] Int. Cl.[2] ..... H01B 7/30; H01B 11/02

[58] Field of Search ..... 307/147, 38; 174/28; 219/300, 301, 10.49, 10.51; 137/341

[56] References Cited

UNITED STATES PATENTS

| | | | |
|---|---|---|---|
| 3,292,016 | 12/1966 | Kafka | 307/147 |
| 3,391,243 | 7/1968 | Whitehead | 174/28 |
| 3,515,837 | 6/1970 | Ando | 219/10.49 |
| 3,522,440 | 8/1970 | Ando | 307/38 |
| 3,524,966 | 8/1970 | Ando | 219/10.49 |
| 3,531,653 | 9/1970 | Willyoung | 307/147 |
| 3,617,699 | 11/1971 | Othmer | 219/300 |
| 3,777,117 | 12/1973 | Othmer | 219/300 |

*Primary Examiner*—David Smith, Jr.

[57] ABSTRACT

A steel tube such as a standard iron or steel pipe having about one-eighth inch or thicker walls and an insulated wire therein may be the two conductor legs of an AC distribution line forming a "tube-wire-cable". The skin effect in the steel limits AC flow to the inner surface of the tube to give the tube more or less the same effective electrical conductivity or resistance as that of the wire, while the outer part of the tube wall of steel acts as an almost perfect insulator, also as the grounding wire, also as a very heavy duty protector of the circuit. Two wires inside the tube may have the maximum voltage drop between them corresponding to a three wire single phase AC distribution cable; and the tube, by its skin effect conduction, may be the neutral or grounded conductor with half the maximum voltage drop between it and each of the wires. Similarly, two wires inside and the skin effect conductor of the tube may be used for three-phase AC distribution.

24 Claims, 15 Drawing Figures

WIRE AND STEEL TUBE AS AC CABLE

This is a second continuation in part of U.S. patent application Ser. No. 107,351, filed Jan. 18, 1971, now U.S. Pat. No. 3,777,117 entitled Electric Heat Generating System Ser. No. 805,718 filed Mar. 10, 1969, and now is U.S. Pat. No. 3,617,699 of Nov. 2, 1971. The first such continuation in part of U.S. Ser. No. 107,351 is also related and was filed Aug. 30, 1973 as U.S. Ser. No. 393,043, entitled Pipe Heating by AC in Steel.

A steel tube is used as one conductor of an electrical AC line, circuit, or cable, wherein an insulated conductor wire inside the tube is the other conductor. Induction and electromagnetic effects of the AC flow in the wire inside develop a skin effect in the steel of the inner wall of the tube which limits the penetration of the AC flow there to an effective depth of about one millimeter for most steels, when standard 50 to 60 cycle AC is flowing. Outside of this inner 1 mm thick skin, the remainder of the thickness of the steel of the wall acts as an almost complete insulator, so that if the wall is several millimeters thick (i.e., about one-eighth inch), the outer surface of the tube is safe to the touch, to grounding, and to contact with other tubes carrying other similar wires and circuits. The outer wall of the tube is usually grounded; and thus it serves as a very efficient ground wire of the AC coaxial cable.

Due to skin effect, the steel tube leg of the AC cable has effectively a cross section roughly equal to the inner perimeter of the tube multiplied by about one millimeter. Usual steels have an electrical resistance about 6 to 6.5 times that of copper; thus, if the two conductor-legs of the circuit — one copper, one steel — are to have the same resistance, as is conventional practice, the cross section of the copper wire, which is insulated and inside the tube, would be about one-sixth or approximately 0.16 of the cross section of this skin effect conductor.

The steel tube has three electrical functions; (a) the inner part or skin as one conductor; (b) the outer part of the wall as the insulation for the conductor; and (c) the outer part of the wall also as a dependable ground "wire". Furthermore, the tube has another important mechanical function, (d) the protection of the inner wire and its insulation from mechanical damage, abrasion, localized external heat, moisture, inflammable gases, etc. This combination of the steel tube with an internal insulated wire may be regarded as an armored cable. Herein it is called a tube-wire-cable, or simply a cable, although it is necessarily less flexible than the usual flexible armored cable. It will usually be much smaller in diameter and weight, contain not more than half as much copper, much less insulation and steel, and be very much less expensive to fabricate and install.

The copending application U.S. Ser. No. 393,043 and U.S. Pat. Nos. 3,617,699 and 3,777,117 describe the phenomena of the skin effect in limiting the effective cross section conductance in steel of what otherwise would be a very massive AC conductor, when the steel is coextensive of and adjacent to an insulated conductor wire, often of copper, the other leg of the line or circuit. In the use of those previous inventions in heating fluid transport pipes and other elongated steel shapes, it has been the object to obtain as high as possible a ratio of the effective resistance to AC flow in the steel tube to that in the wire. The aim has been before the earlier enumerated applications and patents to generate as much heat as possible in the prior art isolated heating tube, which heat is then conducted to the pipe wall; or in these enumerated applications and patents to have as much heat actually generated within the pipe wall. That heat as is possible which was generated in the conductor wire was usually regarded as a necessary line loss, minimal by comparison.

In the prior art, the utilization of the skin effect in steel has been to make the steel tube a more effective resistor by cutting down its effective cross sectional area for conduction. Usually a maximum of resistance is desired so as to heat electrically by a predetermined AC a specific object as a transport pipeline - or in another art, and electrical butt-welding system for steel sheets. The present invention also utilizes the skin effect in steel to make it a conductor only on the inner surface and an insulator throughout the remainder of the wall's thickness. However, now it is particularly desired that the steel shape, in this case usually a tube, have as low an effective resistance as possible so as to keep its line loss at a minimum. For practical purposes this is well achieved when the skin effect conductor has a resistance and consequent line loss per foot of length no more than that of the conductor wire, although in many cases it may be very much less and as little as one-half or one-third. However, there are some installations where other advantages than minimal line loss of the steel tube may be more important; and it may then be advantageous to use a tube with the inner wall skin effect conductor having a resistance per foot or a total line loss or heat generated by the tube of as much as two or even three times of the wire. This is not usually necessary or most economic; but because of the large and uncovered surface of the tube, this heat — always small in amount — is readily lost to the surroundings, and thus is not objectionable since it is not a danger to the circuit.

In a further application of the principles developed in this invention, two insulated wires may be enclosed in a steel tube of round, ellipsoid, or flattened ellipsoid cross section with the two wires as two legs of the three-phase circuit and the skin effect action conductor of the tube as the third; or with the two wires as having the larger voltage (e.g. 240) drop across them, and the tube having half this voltage drop (e.g. 120) to each wire. The tube then acts as what is usually called the "neutral" conductor. Also, two, three, or more wires may be enclosed in the same tube, all the wires on one side of the circuit and in continuous or intermittent service, and the tube acting as the other conductor (common) of the circuit. Similarly, the two internal wires and the skin effect conductor of the tube wall may act as the three conductors of a three-phase circuit.

Particularly it must be noted that the prior usage was to generate heat along the distance of the AC flow and in its conductor-resistor, so as to heat the oil in the pipeline or other fluid in forced motion. This gives a continual loss in voltage along the line as heat was being generated; and this available voltage decreased to zero at the end of the line. Herein, the usage is to minimize the generation of heat along the length of the line, and to prevent insofar as possible the voltage drop and the line loss along the line — so that, if possible the available voltage at the end of the line is, as nearly as possible, that which it was at the start. Obviously there is no fluid in forced motion being heated.

OBJECTS AND ACCOMPLISHMENTS OF THE INVENTION

The invention has, among others, the following objects, which are also accomplished in its utilization in practice:

1. The reduction of the amount of copper required, also of the amount of insulation material required and of the cost of its application in the production of a tube-wire-cable conductor line or cable for AC distribution.

2. The use of a magnetic metal such as steel as both a conductor and as an insulating material in a cable for distribution of AC.

3. The use of one of the conductors of an AC cable uninsulated externally as a superior protection against surface wear and abrasion.

4. The reduction of the size, weight, and cost of manufacture and of installation of an AC cable.

5. The use of a steel tube as one conductor of an AC cable with only the inner skin carrying current due to the skin effect, which also makes the outer part of the steel of the tube wall an effective insulator; the skin effect being developed due to an electromagnetic field generated by the flow of an AC in an insulated wire inside the tube, which is the other conductor.

6. The use of a tube-wire-cable which has two insulated wires inside a steel tube having a skin effect conductor on the inside of the tube. The two wires act as two legs and the steel tube acts as the third leg of a circuit for distribution of three-phase AC, or as the neutral conductor for single phase, 2 voltage AC.

7. The simple production of an economical and completely sealed and waterproof conduit, which may be welded to steel bulkheads or walls which it pierces or by which it is supported.

Other objects and accomplishments are delineated below.

FIGURES

All of the figures are entirely diagramatic and without scale. All wiring and connections are assumed to be insulated; but conductor wires, which are inside the tube used as a skin effect conductor, are shown as a double line.

THE SKIN EFFECT IN AC CIRCUITS

Figure 1:
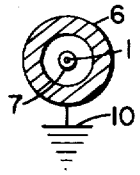
FIG. 1 is a cross section of a tube-wire-cable with one wire.

The skin effect is a phenomenon of electrical conductors made of metals with magnetic properties when in electromagnetic fields. The most common metals exhibiting substantial skin effects are the ferromagnetic metals; and of these ordinary metals carbon steels are by far the most abundant and cheapest. Thus, while the word steel is used herein to describe the most usual ferromagnetic material, there may be used with suitable modifications any other metal which is magnetic and conducts electricity.

The skin effect represents the inability of a magnetic field and of the AC to penetrate a steel conductor. In the present invention, an electromagnetic field surrounds the internal copper wire carrying the AC, and can only penetrate a limited thickness of the inner wall of the steel tube. Since the steel shape is an effective electrical conductor within the thickness of the skin, this skin effect simultaneously represents (a) the inability of the AC under these conditions to penetrate the steel more deeply, and thus (b) the limitation of the cross section of the steel shape which is effective as an AC conductor.

While the conductor wire is most often of copper, sometimes of aluminum, it may be of any other suitable conducting metal.

U.S. Pat. Nos. 3,617,699 and 3,777,117 and the copending application numbered above describe the use of steel as the conductor "wire" in the form of wire, ribbon, tubes, and other shapes. Steel may be used in these shapes in the present invention with the usual consideration of its lower conductivity. Also to be considered is that the skin effect in this second steel conductor (the wire) and inside the other AC conductor (the "tube") may here again limit the effectiveness cross sectional diameter or thickness to not more than twice the penetration depth, or about two millimeters, of the outside of an inner steel wire.

Any conventional insulation material may be used to insulate the wire from the tube; and usually it would be applied in one of the several conventional manners. In some cases, it may be desired to fill completely the space between the wire and the tube with an insulation material so there are no voids. Numerous methods are standard in the art for doing this with the usual solid insulation materials — one less common is with a pulverent mineral packed around the wire or wires in a tube to give a mineral insulation (M.I.). Alternatively, there may be used a polymeric material in which, due to a heat treatment, chemical action causing foaming or otherwise expands from a coating as the insulation on the wire drawn through the tube with considerable clearance. The foaming then fills all voids between the conductor wire and the steel tube. Still other means known to the art may be used for solid materials — and in some cases fluids, i.e., liquids or gases, may be used as the insulation.

The conductor system comprising the insulated wire and the steel pipe may be prefabricated as the finished cable, with both the wire and the tube assembled as a unit. If, alternatively, the tube is installed on the job and the wire is threaded through it as with conventional conduit, it may be desirable to fill completely the tube with insulation — or, more often, annular voids are allowed for ready withdrawal of the wire.

As shown in U.S. Pat. No. 3,617,699, the skin depth and hence the conductance of the tube vary inversely as the square root of the frequency of the A.C. Herein, the conventional 50 to 60 cycles is assumed, however, skin depth and hence the conductance will be greater at lower frequencies, and lower at higher frequences.

Figure 2:
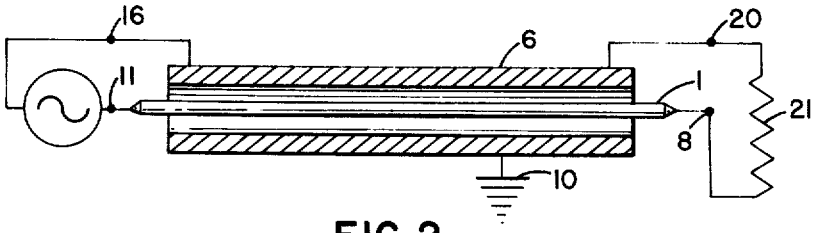
FIG. 2 is a longitudinal cross section of the tube-wire-cable of FIG. 1.

FIG. 1 and FIG. 2 show the conventional and most usual circuit for single phase AC distribution by this tube-wire-cable having two conductors: the internal insulated wire, 1, with its insulation, 7, shown in FIG. 1, and the skin conductance of the tube, 6. These have respective terminals, 11 and 16, for the means for supply of AC, shown diagramatically as an alternator, which AC the two conductors transmit to the respective terminals 8 and 20 of the external load, 21. One or more conventional ground connections, 10, is made to the outside of the tube, 6, at a suitable point or points along its length. Other circuits are possible with two or more wires, sometimes only one is carrying AC at the same time.

Figure 5:
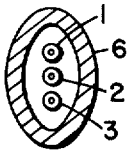
FIG. 5 is a cross section of a tube-wire-cable of ellipsoidal cross section with three wires for three circuits.
Figure 6:
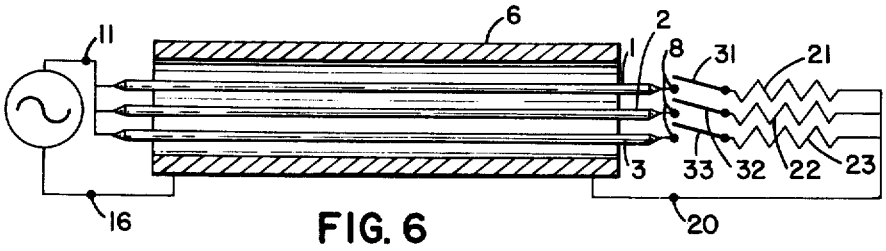
FIG. 6 is a longitudinal cross section of the tube-wire-cable of FIG. 5.

FIG. 5 and FIG. 6 have three insulated wires, 1, 2 and 3, although many could be drawn through the steel tube, 6, which is always the return conductor for the several wires. These wires each have its respective terminals, 8, connected through its respective switching means, 31, 32 or 33, to its respective load, 21, 22 or 23, and is then connected to a common terminal, 20, for the return of the AC through the skin conductance of the tube, 6. By other standard connections, e.g., for power supply to a single load to three-way switches, one of the internal wires may always be idle, while the other two are in use.

Figure 7:
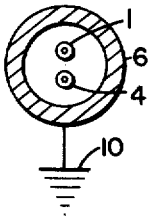
FIG. 7 is a cross section of a tube-wire-cable with two wires for two voltages, with double the voltage difference between the two wires as the voltage difference between either wire and the tube.
Figure 8:
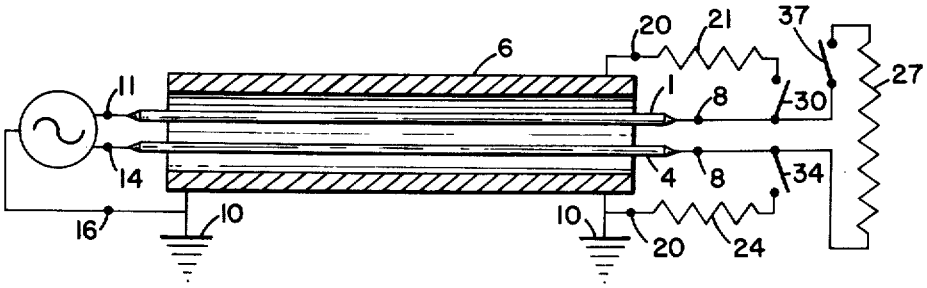
FIG. 8 is a longitudinal cross section of the tube-wire-cable of FIG. 7.

FIG. 7 and FIG. 8 show the use of two wires, 1 and 4, and the skin conductance of the tube, 6, as a tube-wire-cable for transmitting single phase AC of two voltages, e.g., 220 and 110. The two wires, 1 and 4, have the greatest voltage difference between them, 220V, and they are inside the steel tube, 6, the skin effect conductance of which is the third conductor. It is often called the neutral conductor; and it has the same voltage differential between it and each of the two wires. The outside of the tube would have one or more grounded connections, 10.

Thus the voltage between the two terminals, 8, is 220 volts across the 220 volt load, 27, and controlled by switching means, 37, while the voltage between each of the pairs of terminals, 8 and 20, or either of the two wires, 1 and 4, and the tube, 6, is 110 volts across the respective 110 volt loads, 21 and 24, controlled by the respective switches, 30 and 34.

Figure 3:
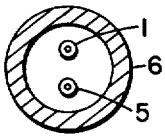
FIG. 3 is a cross section of a tube-wire-cable with two wires for 3-phase A.C.
Figure 4:
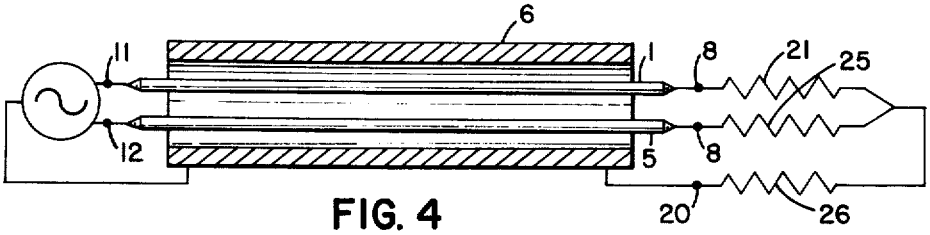
FIG. 4 is a longitudinal cross section of the tube-wire-cable of FIG. 3 and with loads joined in a Y circuit.

FIG. 3 and FIG. 4 show the use of two insulated wires, 1 and 5, inside the steel tube as a tube-wire-cable for transmitting three-phase AC. Again the skin conductance of the tube is the third conductor. The three loads, 21, 25 and 26, are connected in a Y, as conventionally, to the terminals, 8, of the wires, 1 and 5, and the terminal, 20, of the tube, 6, and its skin conductance.

Figure 14:
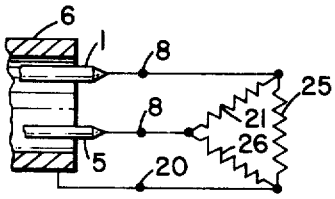
FIG. 14 is a diagram of the three loads of the circuit of FIG. 4 joined in a delta connection.

FIG. 14 shows the wiring diagram of the loads of the three phase AC tube-wire-cable when connected in a delta circuit.

FIG. 5 shows the tube, 6, flattened from the conventional circular cross section to an oval, ellipsoid or similar shape.

The external wall of the tube is grounded at 10 in FIGS. 1, 2, 7, and 8; and it serves throughout its length as a perfect ground wire or grounding wire — and only in its emergency use, in replacing the conventional grounding wire, would it carry current. The wire from the outside of the tube to the ground would not have a fuse in circuit nor serve as the switching side of a single conductor switch.

COMPONENTS OF A SKIN EFFECT TUBE-WIRE CABLE

The copending application U.S. Ser. No. 107,351 now U.S. Pat. No. 3,777,117 shows that under some circumstances in the use of the skin effect conductor-resistor for heating a transport pipeline, AC may be withdrawn from the pipeline heating system for other uses by tapping both the conductor wire and the pipe wall itself. However, the available voltage varied from the maximum of the AC supply to zero throughout the length of the pipe because of the very large line loss due to the resistance heating, which is the major function of the circuit in those uses. Heat was withdrawn and transferred to a fluid in forced flow along the length of the heating circuit.

The present invention demonstrates that, in other cases than a pipeline, the steel tube with a conductor wire inside satisfies the requirements of an AC line or circuit better than conventional wiring, where the primary function is the transmission of AC for uses other than heating of the steel tube and other materials which contact it. Usually, with the present invention, this electrical demand or load is at the far end of a tube-wire system or cable, as with a conventional wiring system; and the voltage drop along the cable is very small by comparison. However, as in most AC lines, power may be drawn off at any point; and the voltage difference between two points along the length will not be substantial because of the comparatively small line loss.

Considering a simple two-wire AC line, it is almost always necessary to supply mechanical protection from adverse outside effects; and the components of a conventional circuit inside a flexible armored cable, may total as many as eight: (a) two electrical conductors, e.g. copper wires; (b) the normal insulation means on each, i.e. a covering for each of the two wires to insulate them from each other, and (c) another paper covering on each to protect them further; (d) an uninsulated ground wire, and (e) a steel tubing of spiral-wound steel covering to give a flexible and armored cable and to enclose the three wires and the four insulations. Thus, there are eight components throughout the entire length.

If now the tube-wire-cable of this invention is used, the number of components is reduced to three: (a) one electric wire; (b) one electrical insulating covering; and (c) the steel tube. The steel tube now serves: (i) as a conductor in its inner skin, (ii) as an external insulation in that part of the wall outside the skin, (iii) on the outside surface as a ground wire, and (iv) an armor for the circuit as a whole. As conventionally, the conductor to the ground carries no current except in case of emergency, such as a short.

The tube will have a somewhat greater wall thickness than the conventional steel conduit or armored cable used only for protection of electric wires. This thickness should be at least twice the depth of the penetration of the magnetic field of the AC flow due to the skin effect. For mild steel, this penetration of the magnetic flux and hence of the AC flow might be about 1 mm; and the thickness of the tube thus should be at least 2 mm, about one-twelfth inch or better, 3 mm, or about ⅛ inch. However, the thicker tube is also an advantage in supplying very much greater armor protection and tensile, compressive, and shear strength than offered by the conventional thin conduit, especially since the tube of this invention usually will be of much smaller diameter. When properly connected, the tube-wire-cable in most constructions is also completely waterproof and hermetically sealed. Although the tube may have a heavier wall than conduit, it may be so much smaller in diameter than conventional conduit that it actually weighs less.

Thus, especially when using the relatively small copper wires of sizes Nos. 16, 14, 12, or 10, which are used in most ultimate distribution of AC where service conditions are improved by an exceptionally heavy protector, and wherein a slight additional amount of line loss in the steel tube may be tolerable, this tube-wire-cable has been found to be a most effective and economical carrier of AC. Because of the high mechanical strength and wear resistance of the tube itself, when constructed of steel of a minimum of about ⅛ inch thickness, also its tightness against moisture and gases, it has been found furthermore that the insulation requirement of the inner wire itself is minimized; and, as noted above, the outer part of the steel wall of the tube acts as its own electrical insulation. Also, the outer part of the wall serves as a grounding wire.

This tube-wire-cable becomess most effective with the smaller current, up to 100 amperes, and relative low voltage, up to 220 or 440 volts, of AC distribution in homes, offices, for most lighting circuits, etc., although this does not preclude the use of relatively larger steel tubes and electric conductors, depending on the particular service, and the advantages and disadvantages of minimizing line losses. In such ultimate distribution of AC from its supply source to the lod, the line is usually less than 500 feet long. Thus it has a very low voltage drop from end to end compared to the heat generating systems on oil transport lines many times as long in the prior usage, wherein the voltage drop is 100 percent from end to end in heating the fluid in forced flow therein.

Different design conditions are used under different conditions to minimize the total line loss developed in the use of this tube-wire-cable, which may be in either usual environments, or in installations either underwater or underground. Obviously also, the outer surface of the steel tube may have any desired resinous or polymeric coating for further protection against corrosion; or it may be coated with another more corrosion resistant metal, applied molten, electroplated, or otherwise. Such metals for coating the steel tube outside may be zinc, aluminum, lead, copper, cadmium, etc.

The steel tube, as always, would be well grounded, as shown in FIGS. 1, 2, 7 and 8 as is conventional with conduits for electrical current; and the outside of the wall serves in this capacity as the usual grounding wire or connection. In AC service, the tube-wire-cable is wired the same as in wiring any other conductors, with the connection to the terminals of the AC at one end, as in FIG. 1 at 11 and 16 and to the terminals 8 and 20 of the load, 21 at the other. The tube, or its effective skin-effect conductor may be regarded as the grounded or neutral conductor or wire. When the proper size tube is used, the tube-wire-cable with a given wire size should have no more voltage drop than with the conventional line with two wires of the given size. Standard switching mechanisms 31, 32 and 33 are used as shown in FIG. 6 for each of the three loads 21, 22, and 23, respectively either installed in circuit with the tube-wire-cable, or on either end of that part of the circuit. The wire side of the tube-wire-cable may be used for single conductor switches, also for fusing.

The AC connection to the tube on both the power end and the load end may be made to the outside by clamps or otherwise, usually but not necessarily next to the cut or break which would be made to reach the internal wire. The AC flows directly through the tube wall at the point of contact with the outer steel surface to the internal skin effect conductor, where it flows as has been described in the copending applications. Immediately around the point of contact with the outside of the tube — for a distance of one or two times the penetration depth of 0.04–0.08 inch — there will be a flow of current; and this small "hot" area may be covered with insulation to prevent an accidental short. Outside of this distance the steel of the tube acts as the insulator from the skin effect conductor as described above.

In some installations, e.g., aboard ship, electric power cables and lines should be watertight, and the tube-wire-cable with suitable couplings may be constructed so readily. Also, in piercing steel partitions or bulkheads, it may be required that some cabin, hold, or other space in the ship be preserved watertight. This is readily done by piercing a hole through the sheet steel the size of the tube, installing the tube through the hold, welding the tube to the bulkhead, and drawing the wire.

This special tube-wire-cable may be fabricated as a factory product. Then the tube is made of steel as soft and malleable as may be, with the insulated wire drawn through it at the factory.

It may be desirable after drawing the insulated wire to shrink the size of the tube by a minor cold rolling operation, so that it fits snugly around the insulation with the wire inside, or, as mentioned above, to use the insulation which, by known processing methods, expands to fill the tube completely. In cutting the tube, with a standard pipe cutter, a slight burr or internal flange is always turned in, which nips slightly into the insulation to form a tight joint therewith.

In the normal sizes of such tubes, it is possible with hand tools to bend such a tube-wire-cable to form corners, as is done in working standard rigid conduit, the larger sizes having larger radii of curvature. As with rigid conduit, the larger size tubes would use factory bent elbows. If the size of the wire is above No. 8 AWG, it is stranded as in usual practice to allow flexibility in the bend, whether prefabricated or bent on the job. This is not necessary with sizes of tube-wire-cable used most often. As with conventional AC lines or cables, taps may be taken from the tube-wire-cable at desired points, utilizing either two conventional conductor wires or an additional tube-wire-cable. The circuitry is the same as for conventional wiring, always using the tube conductor as the neutral or grounded conductor and the wire as the hot conductor.

CARRYING CAPACITY OF TUBE-WIRE-CABLES

The carrying capacity of AC conductors which is rated as safe and allowable in practice for a given wire size is based to a large extent on the probable ability of the conductor in continuous service to dissipate the heat of the electrical line loss. With the tube-wire-cable of this invention, this ability is many times greater than with conventional cables because the insulation of the tube is the steel itself of the outer part of the wall. Hence, the external surface is uncovered with the conventional electrical insulation, which is also a good thermal insulation against heat loss. The external steel surface which dissipates the heat of both wire and tube is much larger than that of two separate insulated copper wires and thus can dissipate heat to air, water, or other surroundings at a correspondingly higher rate. Also, while the single wire of this invention has to lose the heat of its line loss through its insulation to the tube, with conventional circuits in conduits, both wires of conventional circuits have to lose their heat in this way. Furthermore, in the tube-wire-cable, the distance for this heat transfer is so short and the capability of the steel tube to absorb and then dissipate this heat is so large that there is no measurable temperature gradient across the tube wall.

Also, from a consideration of the possible hazard due to the destruction of the insulation through overheating and consequent melting, burning or otherwise, this hazard is eliminated since the steel of the tube is the only external insulator. And since the insulation of the wire inside is entirely and compactly enclosed away from the oxygen of the air, it retains most of its insulating valve even at temperatures at which it might be seriously damaged if overheated due to external cause. Also, if the insulation should fail completely, the circuit is shorted and taken out of service by some form of circuit breaker, a fail-safe mechanism, rather than being available for damage by arcing, which might set fire to surrounding materials.

The tube of this invention will have a thicker skin effect conductance at lower A.C. frequencies, and thinner at higher A.C. frequencies, than the 50 to 60 cycles considered here; and these may be designed for.

SIZES OF TUBES FOR TUBE-WIRE-CABLES

Such tube-wire-cables have been found to be relatively low in costs of both materials and installation, especially for moderate loads up to 100 amperes at 220 or 440 volts. Particularly in the most commonly used range of current flow, the tube is designed so as to have about the same resistance or line loss as that of a conventional AC line of two wires, of the same size as the single wire of the tube-wire-cable. Thus, there will be about the same line loss as from a conventional two-wire circuit; and a much smaller and lighter cable system results at a much lower cost per foot especially for wire sizes of No. 10 to No. 16.

Also, it follows that the carrying capacity of the wire, measured as the area of its cross section, will increase as the square of its diameter. However, the effective conducting cross section of the steel tube, i.e., the skin, increases only as the first power of the tube's internal diameter, since it represents the cross section of a skin of a constant depth of penetration of AC flow of about 1 mm. This consideration, however, does not take into account the thickness of the insulation on the wire or other distance between wire and steel.

The system of this invention usually requires only one-half (or less) weight of copper and of insulation and usually considerably less steel as compared to the conventional rigid conduit with two wires; and it has the same advantages over the conventional flexible spiral-wound 2-wire armored steel cable. It also requires substantially less weight of steel; although the tubing may have a thicker wall, it is much smaller in diameter, thus weighs less per foot. Particularly for the service of ultimate distribution in homes, offices, lighting circuits (No. 14, No. 12, and No. 10 wire sizes) the economies in materials and installation time are considerable.

TUBES OF IPS SCHEDULE 80

The simplest, most available, and cheapest tube-conductor may be iron pipe size (IPS) steel pipe (often with standard fittings) through which the wire is drawn. This allows the use of standard pipe threading equipment — also used for so-called rigid conduit, however of larger size than used here. However, standard pipe or rigid conduit fittings may be used where applicable.

Other steel fittings — screwed, flanged, or of other type — maintain the skin effect circuit equally well through the joining of two lengths of tube; and providing the joints are tight — metal to metal, i.e., steel to steel and no gaskets, and there is good electrical contact — there is only a relatively small line loss at such connections, and no danger of electric shock. Conventional rigid conduit is also of standard pipe size; but with this invention smaller sizes than the smallest rigid conduit (one-half inch IPS) are important for the lighter wire sizes used in conventional distribution systems.

As an example the dimensions of a suitable steel tube may be those of a one-fourth inch IPS Schedule 80 steel pipe, i.e., OD = 0.540 inch, ID = 0.302 inch, inside perimeter 0.95 inch, wall thickness = 0.119 inch, cross section of steel — 0.157 square inches, and weighing 0.54 pounds per foot. This may have an effective skin conductor cross-sectional area of approximately 0.04 square inches; and thus would be the equivalent of steel wire of 0.04 square inches. The resistance of steel is about one-sixth that of copper, so this would be equivalent to the resistance of a copper wire of about 0.007 square inch.

No. 11 (AWG) is 0.091 inch in diameter and has a cross-section of 0.0065 sq. in.; No. 10 is 0.102 inch in diameter and has a cross section of 0.00816 square inches; and No. 12 is 0.081 inch in diameter and has a cross section of 0.0051 sq. in. Thus, the combined resistance of the heat-tube made up of a length of one-fourth inch IPS Schedule 80 steel pipe as one leg of the circuit, and a No. 11 (AWG) copper wire, will be slightly less than the resistance of a normal 2-wire circuit of No. 11 wire. The difference between the diameter of the wire and that of the heat-tube would thus be 0.211 inch to allow a free space for insulation of 0.1 inch all around the wire.

The insulation of the wire could thus be as thick as 0.1 inch; and if thinner insulation is used, as normally would be, the wire could be drawn through the tube. If desired, and a slightly larger tube had been used, the tube then could be cold-rolled tightly against it with a slight dimunition of diameter, or the insulation could be expanded after drawing. Alternatively, a thinner insulation, say 0.05 inch, which would be adequate, would allow drawing the insulated wire through the one-fourth inch IPS tube. The clearance of the insulated wire would be greater with No. 12 wire, a standard for much usual wiring for home and office lights and outlets, and it would be readily drawn through the tube in place. The resistance and heat given off in both legs of the AC circuit for a No. 12 wire in a one-fourth inch IPS pipe would be less than that of two No. 12 wires as conventionally used.

As a practical matter, and with insulation of about 20 to 50 mills thickness for much service wiring for ultimate distribution, it has been found that the insulated wire may be pulled conveniently through the steel tubes after having long radius bends formed, or separately connected, as is conventional practice with conduit.

Using Schedule 80 IPS steel pipe as tubes, the resistance and hence the heat loss from the protecting steel tube, plus that from the wire of the indicated size, may usually be about the same or slightly more than for two copper conductor wires of the same size, i.e., the line loss of the conventional system and of the system of this invention is not greatly different. With copper wire:

- No. 12 or No. 14 AWG — Use Steel-Tube of one-eighth inch IPS Schedule 80.
- No. 10 or No. 12 AWG — Use Steel-Tube of one-fourth inch IPS Schedule 80.
- No. 8 or No. 10 AWG — Use Steel-Tube of three-eighths inch IPS Schedule 80.
- No. 8 AWG — Use Steel-Tube of one-half inch IPS Schedule 80.
- No. 6 or No. 7 AWG — Use Steel-Tube of three-fourths inch IPS Schedule 80.
- No. 4 or No. 6 AWG — Use Steel-Tube of 1 inch IPS Sch. 80 or Sch. 40.

The conclusion is: if the inside perimeter of the heat-tube is multipled by 0.04 inch (skin thickness) divided by 6 (ratio of resistance of steel to copper), and this value of the cross section of the effective skin, or 0.0067 times the inner perimeter, is the same as the cross-section of the wire, the effective resistances of the tube is approximately equal to that of the wire. Here there are considered standard sizes of wire and of IPS tubes.

This may be stated another way, if the inner 0.04 inch of the wall thickness of the steel tube, representing the effective skin effect conductor, is divided by approximately 6, the value in square inches is the approximate cross section of a copper wire of equivalent resistance. (For aluminum, the divisor is approximately 3.5). If it is desired that the effective resistance of the steel tube be about the same as that of the conductor, the skin effect cross section of the inner part of the steel tube, when divided by approximately 6, gives the cross section of the copper wire to be used; or the skin effect cross section of the steel tube divided by approximately 3.5 gives the cross section of the aluminum wire to be used. In general, for practical usage, these divisors may range from 4 to 10 for copper and from 2 to 5 for aluminum.

Since the carrying capacity for AC of the wire increases as the square of its diameter, while that of the tube increases only as the first power of its diameter, the tube becomes rather large by comparison to the wire with current flow much over 100 amperes.

Dimensions of the cross sections of the conductors, both wire and tube, are given here in inches and square inches. While those of the wire may be considered in circular mils, this unit does not aid much in the consideration of the steel tube and the cross section of its skin effect conductor, compared to the simplifying assumption that its area may be approximate the internal perimeter times 0.04 inch or 1 mm for most steels. For small tubes, calculations are made better by subtracting the cross sectional area of a circle having a radius of the inside of the tube from that of a circle with a radius of this value plus that of the skin effect, i.e., the depth of penetration, or 0.04 inch.

Another factor also enters, i.e., the proximity effect, as the size of the tube increases in comparison to that of the wire. As detailed in now U.S. Pat. No. 3,777,117, the placing of the wire eccentrically increases the effective resistance of the tube. This was an advantage in the use of that invention, but is a disadvantage here. Unless special provision is made, the wire will lie on the bottom of the tube. Because of the relative thickness of the normal insulation of the wire which supports the wire from the bottom of the tube, this does not become an important factor in tube sizes smaller than 1 inch IPS. However, this can be overcome in the assembly of the tube and the insulated wire by forming in place at uniform spacing along the length a short section of a foam material such as urea-formaldehyde polysytrene, polyurethane, etc. or otherwise supporting this wire along the axis by mechanical spacers.

Schedule 80, sometimes called Extra Strong, IPS tubes are necessary in the smaller sizes so as to have a wall thickness of 2 or 3 times the skin depth when using conventional 50 to 60 cycle A.C.

TUBES SMALLER THAN IPS

In the above, the tube has been considered as most conveniently and readily available as standard Schedule 80 IPS steel tubing; and the range of sizes so available and standard throughout the world is usually adequate.

A smaller than one-eighth inch IPS tube may be used in many installations; e.g., a No. 14 (AWG) copper wire with 20 mill thick insulation will have about 130 percent as much line loss when installed in steel tube of 0.16 inch ID, and 0.40 inch OD as the steel tube; a No. 16 wire with the same insulation will have about 170 percent as much line loss when installed in a steel tube of one-eighth inch ID and three-eighths inch OD as the steel tube; a No. 18 wire with the same insulation will have about 245 percent as much line loss when installed in a steel tube of 0.11 inch ID and 0.35 inch OD as the steel tube; and a No. 20 wire with the same insulation will have about 350 percent as much line loss when installed in a steel tube of 0.095 inch ID and 0.33 inch OD as the tube. Thus, in each case, the tube has very much greater carrying capacity than the wire, while still preserving its insulation value in the outer part of its wall.

Even smaller wire sizes for low voltages may be used in smaller steel tubes where a well protected circuit is necessary. Usually the thickness of the insulation of the wire may be reduced greatly. Also, the thickness of the tube wall may be reduced to twice the penetration depth, about 0.08 inch or even lower, for such lower voltage AC applications.

These figures are not exactly comparable, but they do indicate very well the point long noted in work with the skin effect in steel tubes enclosing the copper conductor — that the line loss or heat effect generated in the tube compared to that in the copper wire becomes very much less as the size of the tube decreases, since the area of the skin effect conductor varies as the first power of its diameter, while that of the copper wire conductor varies as the square of its diameter.

Other tube sizes than standard IPS may be rolled or drawn of steel or other magnetic, electrically conductive metal to fit more exactly any unusual specifications; and standard steel tubing drawn or rolled for other particular purposes thus may be used in this invention.

SPLICES OR CONNECTIONS

Figure 15:
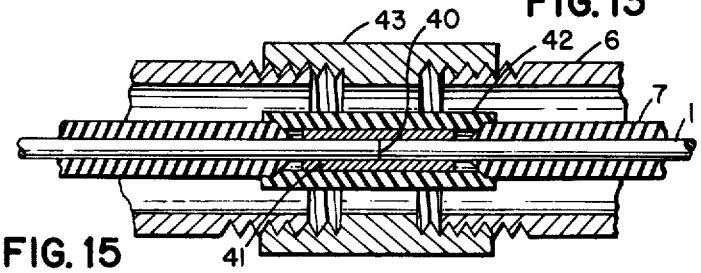
FIG. 15 is a cross section of a tube-wire-cable with a screwed steel sleeve joining the ends of connecting tube lengths and an insulated sleeve covering joining the corresponding ends of the wire.

As with all electrical conductors, splices must be made. With the inner wire of the tube-wire-cable, the splice is made conventionally; or as in FIG. 15 a butt joint of the bare wire ends, 40, may have a soft metal sleeve covering, 41, which covering is crimped to insure the mechanical and electrical connection, and then taped. The cross section of the tape or similar insulation is shown at 42. Alternatively a jumper wire may connect the respective ends of two tube sections; and the junctions are taped as usual.

A steel sleeve, 43, over the two ends of tubes to be joined may utilize the skin effect on its inner wall in carrying the AC across such a junction, either at a point where the copper wire is also spliced or at any point in the circuit where lengths of tubing which have been installed prior to pulling through the wire. Again, this sleeve must be firmly fitted to insure the mechanical connection and strength of the joint and a minimum of electrical resistance. As noted above, standard iron pipe size steel tubing may be used; and thus standard screwed couplings, of a thickness greater than about one-eighth inch and threaded on tightly, give excellent mechanical strength and electrical conductance — by the skin effect in the coupling's length — as well as a hermetical seal if necessary. Such couplings are available as standard with right hand threads on both ends, and also with right and left hand threads where desired for fitting where the tube should not be turned.

Other standard fittings for iron pipe size or other tubing may be used, or they may be modified slightly to allow for splicing the wire, and for making connections to or in boxes for outlets, switches, receptacles, etc.

TUBES OF NON-CONVENTIONAL SHAPES

If the circuit does not need to be waterproof, the tube may be made of sheet skelp without a welding of the longitudinal joint. The steel skelp may be formed first as an open "C" in cross section of any desired length as 50 in FIGS. 11 and 12. The insulated wire may then be inserted longitudinally; and the C section is cold rolled or otherwise compressed to close to an approximately circular cross section with a butt joint or with a slight crack or concavity at the butt point to give a reasonably tight fit. Alternatively, the wire may not be inserted in the factory, but may be pulled on the job.

Figure 11:
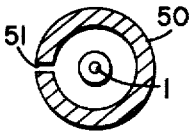
FIG. 11 is a cross section of a concave elongated shape with a longitudinal crack and a conductor wire.
Figure 12:
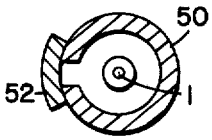
FIG. 12 is a cross section of a concave elongated shape with a longitudinal opening covered by a strip of steel.

The tube-wire-cable thus as in FIG. 11 may have the tube with a thin crack, 51, down the side; or, as in FIG. 12, it may be constructed of two strips of steel, the second, 52, held in place tightly against the open C of the first, 50. Together, the two strips — or more than two strips — may be used to form a tube of any convenient shape of cross section. Thus, the open shape 50, either of C-shape as in FIG. 12 or of flat U-shape, may have a flat strip, 52, held in place to close it and surround the wire, except for longitudinal cracks. Or a clip action means formed by longitudinal crimping along both edges may snap the two pieces together. The tube may be flattened on the one side to have holes punched or drilled for screws (steel) to support it to walls or other parts of the building. Such conduits — of lighter gauge steel — are in conventional use carrying two wires, e.g., with one length fastened to a wall, the two wires inserted, and the other and mating length then rigidly attached in place.

Another method of forming wraps skelp helically into a tube on a mandrel, and welds tightly or leaves open a crack or joint between wrappings. Continuous machines make pipe in a helical wrap from skelp. Depending on the freedom from mill scale at the edges of the skelp, some resistance to AC flow may be encountered there. However, if the skelp is such that the angle of the rolling is not more than about 30° with the axis, any added electrical resistance along the helix compared to straight line flow is not important. The overall resistance of the tube may be unaffected practically with or without welding the joint; and, as with most tube-wire-cable designs, the line loss of the tube may be less than that of the wire, i.e., the overall line loss — out and back — is less than the conventional.

With an open seam or seamless, butt welded or helically welded tubing may be made more or less continuously and cut to desired lengths, e.g., 20 feet. A short section of the ends of the wire would not be covered by the steel tube, and some of the insulation would be removed to leave bare ends of the wires. Thus, the tube-wire-cable would be readily spliced in the field by quick connecting and clamping fittings, or otherwise.

In this invention, when the two or more steel strips, preferably at least one-eighth inch in thickness, and taken together more or less encompass longitudinally the wire, they are electrically connected in parallel to form together by their combined skin effect conductance one leg of the A.C. circuit, the other of which is the conductor wire.

Figure 10:
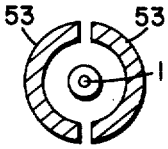
FIG. 10 is a cross section of two concave elongated shapes partially encompassing a conductor wire.

The operation of the system of this invention is the same whether the tube is made up of one or more steel shapes as the semi-circular channels, 53, of FIG. 10. These are formed by seamless drawing, or from skelp which is formed by conventional rolling or helical wrapping, either with or without one or more welded joints. Connection fittings vary with the method of constructing the tube.

Figure 9:
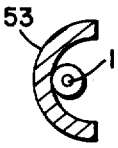
FIG. 9 is a cross section of a concave elongated shape and a conductor wire within the concavity of the elongated shape.

In some uses where insulation may not be a problem, the steel shape may not even be a tube as the term is usually used; and it may not enclose or encompass longitudinally the conductor wire. As noted above, it may be an open C-shape as the semicircular channel, 53, of FIG. 9 with the wire inside, but not finally closed around or encompassed; or it may even be a strip of steel shape having a concave, flat, or even convex side, the surface of which is against or adjacent to the insulated wire. The proximity effect is important in limiting the cross sectional area of skin effect conductance in the steel shape as described in copending application U.S. Ser. No. 393,043; and in the present use, the steel shape as a conductor would be designed so that it would have a resistance about the same as that of the wire, or not more than two or three times that of the wire. That part of the steel shape outside of the skin effect conductance defined by the proximity effect of the adjacent wire and its magnetic field acts as an insulator, as described above.

Figure 13:
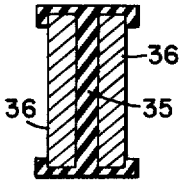
FIG. 13 is the cross section of a cable made up of two strips of steel of thickness at least twice the skin depth and insulated by an I-shaped insulator extending around the ends to prevent external contact with the skin through which AC is flowing.

In an unusual case of FIG. 13, two steel shapes 36 may be adjacent to, but insulated from, each other; and they form the out-and-back legs conducting an AC circuit. These may be strips or other shapes of either the same or different cross sections or sizes. If that part of the cross section of each steel strip closest the other is more than about the one-eighth inch thickness of the skin effect conductor, the balance acts as an insulator, much better as the thickness increases. This might be an elongated "sandwich" of two flat steel strips with a strip of insulating material 35 between. If the insulation is formed with the cross section of a capital "I", and with the steel strips nested between the flanges, these flanges should overlap the edges of the steel strips by an amount of about 2 or 3 times the skin depth or about one-eighth inch, so as to insulate outside objects from contact or possible short.

THREE PHASE AC DISTRIBUTION WITH TUBE-WIRE-CABLE

While the largest number of AC distribution lines to the point of actual power utilization are single phase, except those connecting larger electric motors, three phase distribution of AC is also very important.

As noted above, a tube-wire-cable for single phase may readily be designed with the tube and the axial wire of substantially the same effective resistance. Similarly, a three-phase line may be used as in FIG. 3 and FIG. 4 with two wires, 1 and 5, inside the steel tube which itself acts as a third conductor because of the skin effect. The skin effect conductance may be balanced so that the tube approaches as closely as desired the line loss of the two wires, which usually would be equal. The connections with the three loads 21, 25 and 26, at the far end of the tube-wire-cable would be made as conventionally with either a "Y" or a delta arrangement. The Y connection is shown in FIG. 4, the delta is shown in FIG. 14.

The two wires inside the tube may have conventional insulation, and be spaced on a diameter of the tube, or the insulation may be molded so the two insulated wires conform more closely to the inside of the tube.

Alternatively, the cross section of the tube itself may be shaped better to fit the two circular insulated wires, by being eliptical or flattened eliptical. The junction fittings for a tube of such cross section for one conductor of a three phase line are somewhat more difficult of design, construction, and use than those of circular cross section.

Such special design of the tube might be used for the case where two wires as conductors are installed in a tube as a single phase circuit with: (a) only one wire being used at a time, as for a three-way switch; or (b) as in FIG. 8 both wires 1 and 4 being used to give the maximum voltage difference, (e.g., 220 volts) with the tube, 6, as the neutral or grounded wire having one-half the voltage drop (e.g., 110 volts) to either of the wires, 1 or 4.

I claim:

1. A system for conducting AC comprising:

a. means for supply of AC having at least two terminals, a first and a second;

b. at least one elongated electrical conductor means, insulated throughout its length and having a near end and a far end;

c. at least one elongated shape, having a near end and a far end, which is:

i. made of a ferromagnetic material having electrical conductivity;

ii. adjacent to and coextensive of at least most of the length of said electrical conductor means;

iii. capable of concentrating the flow of said AC when flowing in one direction of its length in a skin having conductance adjacent to and coextensive of the length of said electrical conductor means, said skin conductance concentrating being due to the electromagnetic field generated when said AC flows in a reverse direction in said adjacent electrical conducting means;

iv. of a thickness at least twice the depth of said skin in which said flow of AC is concentrated;

d. means for electrically connecting said first terminal of said AC supply means and said near end of said electrical conductor means;

e. means for electrically connecting said second terminal of said AC supply means and said near end of said elongated shape;

f. at least one electrical load with means for electrically connecting a first terminal of said load to said far end of said electrical conductor means, and means for electrically connecting a second terminal of said load to said far end of said elongated shape;

g. an electrical circuit established:

i. from said first terminal of said AC supply means through the substantial length of said electrical conductor means; then ii. through said electrical load; then iii. back through said substantial part of the length of said elongated shape so as to produce a skin effect current which is concentrated near the surface of that part of said elongated shape which is adjacent to said electrical conducting means; and at least some part of the cross section of said elongated shape outside of the surface skin wherein skin effect current is concentrated becomes an effective electrical insulator; and the surface on the far side of said elongated shape from said electrical conductor means carries only a negligibly small amount of current; then finally iv. back to said second terminal of said AC supply means to complete the electrical circuit; wherein h. the resistance of said electrical load is large compared to the resistance of said electrical conductor plus the resistance of said elongated shape as controlled by said skin effect therein.

2. In the system of claim 1, wherein the effective resistance and the resulting line loss of said elongated shape with its skin effect conductance are between one-third and three times the respective corresponding values of said electrical conductor means in the length where said elongated shape and said electrical conductor means are adjacent and coextensive.

3. In the system of claim 1, wherein:

a. said electrical conductor means comprises a multiplicity of wires, each having a near end and a far end, said wires being coextensive with and insulated from each other and from said elongated shape;

b. said means for electrically connecting said first terminal of said AC supply means connects with said near end of each individual one of said multiplicity of wires;

c. means is provided for electrically connecting said first terminal of an individual electrical load to said far end of each of said wires, and for electrically connecting said second terminal of each individual electrical load to said far end of said elongated shape; and d. means is provided for making and breaking the flow of AC in said means for electrically connecting said first terminal of an individual electrical load to said far end of each of said wires.

4. In the system of claim 1, wherein the wall of said elongated shape is at least ⅛ inch thick.

5. In the system of claim 1 wherein means are provided to connect electrically the outside of said elongated shape to the ground, while said skin of the inside surface of said elongated shape continues to carry a flow of AC which is not lost to the ground.

6. In the system of claim 1 wherein there are at least two elongated shapes, said elongated shapes are coextensive of the length of and adjacent to said electrical conductor means, and of such cross sectional configurations respectively that said shapes when taken together at least partially encompass at least one of said electrical conductor means throughout its length; and means are provided for electrically connecting said elongated shapes so that said AC flows along their respective lengths in parallel, and said skin effect currents carried in all of said shapes are additive, to equal that carried in said conductor means.

7. In the system of claim 1 wherein said elongated shape is concave in cross section, with said electrical conductor means coextensive of, adjacent to, and within the concavity of said shape; but said shape does not completely encompass said electrical conductor means, and leaves an elongated opening along said edges of said shape in its cross section as finally formed.

8. In the system of claim 7 wherein said opening along said edges is merely a crack between said edges.

9. In the system of claim 7 wherein said edges are parallel to the axis of said shape, said electrical conductor means may be inserted in such elongated opening, a steel cover of at least ⅛ inch thickness is held in place over said longitudinal opening, the inner skin of said steel cover becoming a skin effect conductor of said AC to add its conductance to that of said skin effect conductor of said elongated shape.

10. In the system of claim 1 wherein said elongated shape is a steel tube in which is encompassed longitudinally said insulated electrical conductor means.

11. In the system of claim 10 wherein said electrical conductor means comprises at least two insulated wires, each of said wires has a near end and a far end and each is coextensive of the length of said steel tube and is encompassed longitudinally in said steel tube.

12. In the system of claim 11 wherein said steel tube is formed in a substantially ellipsoid cross section to accomodate more closely said insulated wire.

13. In the system of claim 10 wherein:

a. said insulated electrical conductor means is an insulated copper wire; and b. said copper wire has a cross section in square inches of from one-fourth to one-tenth of the cross section of the inner 0.04 inches of the wall thickness of said steel tube.

14. In the system of claim 10 wherein:

a. said insulated electrical conductor means is an insulated aluminum wire; and b. said aluminum wire has a cross section in square inches of from one-half to one-fifth the cross section of the inner 0.04 inches of the wall thickness of said steel tube.

15. In the system of claim 10 wherein means are provided for connecting mechanically and electrically at an end of each of two such tubes to make a new and longer steel tube, said means comprising a closely fitted steel sleeve coupling having a wall thickness of at least one-eighth inch, said steel coupling covering a short length of the connecting end of each of said original steel tubes; and said steel coupling conducting between at least the distance between said ends of said steel tubes said AC by skin effect conductance on its inner wall while its outer wall becomes an effective electrical insulator.

16. In the system of claim 15 wherein means are provided for splicing electrically and mechanically the ends of two of said elongated electrical conductor means under said steel coupling.

17. In the system of claim 15 wherein said steel sleeve coupling is provided with internal screw threads which engage corresponding external screw threads provided on the joined ends of each of said original steel tubes.

18. In the system of claim 11 wherein said electrical conductor means comprises two insulated wires, a first and a second.

19. In the system of claim 18 wherein said two wires are used alternatively and only one at a time as the electrical connection from said AC source to said AC load.

20. In the system of claim 18 wherein:

a. said means for supply of AC has, in addition to said first terminal and said second terminal, also a third terminal, with a higher voltage supply between said first terminal and said third terminal and a lower voltage supply, one-half as high as said higher voltage supply, between said first terminal and said second terminal, and another lower voltage supply, also one-half as high as said higher voltage supply between said second terminal and said third terminal;

b. said means for electrically connecting said first terminal of said AC supply means connects with the near end of said first wire;

c. said means for electrically connecting said second terminal of said AC supply means connects with the near end of said steel tube so that said skin effect conductance of said steel tube makes said steel tube act as the neutral conductor;

d. means are provided for electrically connecting said third terminal of said AC supply means with the near end of said second wire;

e. means are provided for electrically connecting said first terminal of a first electrical load utilizing said higher voltage supply to said far end of said first wire, and for electrically connecting said second terminal of said first electrical load utilizing said higher voltage supply to said far end of said second wire;

f. means are provided for electrically connecting said first terminal of a second electrical load utilizing said lower voltage supply to said far end of said first wire, and for electrically connecting said second terminal of said second electrical load to said far end of said tube; and g. means are provided for electrically connecting said first terminal of a third electrical load utilizing said lower voltage supply to said far end of said second wire, and for electrically connecting said second terminal of said third electrical load to said far end of said tube.

21. In the system of claim 18 wherein:

a. said means for supply of AC delivers three phase with three AC terminals, a first, a second, and a third, and said two wires and the skin effect conductance of said tube are the respective conductors of the three respective phases of AC from said source to said electrical load;

b. means are provided for electrically connecting respectively said near ends of said two wires to said first and said third AC supply terminals, and the near end of said tube to said second AC terminal; and c. means are provided for electrically connecting said far ends of said two wires and of said tube to the respective terminals of the three individual electrical loads of each of said three phases of AC supply.

22. In the system of claim 21 wherein means are also provided for connecting electrically the three respective electrical loads to said far ends of said three respective conductors in a Y pattern.

23. In the system of claim 21 wherein means are also provided for connecting electrically the three respective electrical loads to said far ends of said three respective conductors in a delta pattern.

24. In the system of claim 1 wherein said conductor means is made of a ferromagnetic material and is electrically conductive.

* * * * *